US011434730B2

(12) United States Patent
Surjaatmadja et al.

(10) Patent No.: US 11,434,730 B2
(45) Date of Patent: Sep. 6, 2022

(54) STIMULATION TREATMENT USING ACCURATE COLLISION TIMING OF PRESSURE PULSES OR WAVES

(71) Applicant: Halliburton Energy Services, Inc., Houston, TX (US)

(72) Inventors: Jim Basuki Surjaatmadja, Duncan, OK (US); Tim H. Hunter, Duncan, OK (US); Stanley V. Stephenson, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 109 days.

(21) Appl. No.: 16/972,980

(22) PCT Filed: Jul. 20, 2018

(86) PCT No.: PCT/US2018/043037

§ 371 (c)(1),
(2) Date: Dec. 7, 2020

(87) PCT Pub. No.: WO2020/018112

PCT Pub. Date: Jan. 23, 2020

(65) Prior Publication Data

US 2021/0254439 A1 Aug. 19, 2021

(51) Int. Cl.

| | |
|---|---|
| ***E21B 43/114*** | (2006.01) |
| ***E21B 43/263*** | (2006.01) |
| ***E21B 43/26*** | (2006.01) |

(52) U.S. Cl.

CPC ..... *E21B 43/114* (2013.01); *E21B 43/26* (2013.01)

(58) Field of Classification Search

CPC .... E21B 43/117; E21B 43/116; E21B 43/162; E21B 43/26; E21B 43/2607; E21B 43/263; E21B 43/114; E21B 29/02

See application file for complete search history.

(56) References Cited

U.S. PATENT DOCUMENTS 3,602,311 A * 8/1971 Whitsitt ..... E21B 43/26 166/308.1

4,823,875 A 4/1989 Hill (Continued)

FOREIGN PATENT DOCUMENTS

WO 2013/092710 A2 6/2013

OTHER PUBLICATIONS

International Preliminary Report on Patentability issued in related PCT Application No. PCT/US2018/043037 dated Feb. 4, 2021, 7 pages.

(Continued)

*Primary Examiner* — Kenneth L Thompson

(74) *Attorney, Agent, or Firm* — Conley Rose, P.C.; Rodney B. Carroll

(57) ABSTRACT

An injection pumping system is used to generate pressure pulses in a wellbore to create pressure spikes for stimulation treatment of the wellbore. An initial pressure pulse is generated with a known travel time from the surface to a termination point and back to a specified location within the wellbore. A subsequent pressure pulse with a known travel time from the surface to the specified location can be generated to collide with the initial pressure pulse at the specified location. Knowing the speed of sound throughout the wellbore allows for an accurate calculation of the required travel times for each of the pressure pulses. Multiple sections of the wellbore can be treated preferentially and independently without requiring multiple runs of a perforating tool as the pressure pulses can be manipulated to collide at different locations throughout the wellbore based on the known travel times.

21 Claims, 8 Drawing Sheets

(56) References Cited

U.S. PATENT DOCUMENTS

| | | | | |
|---|---|---|---|---|
| 4,858,130 | A | 8/1989 | Widrow | |
| 5,411,091 | A | 5/1995 | Jennings, Jr. | |
| 7,313,481 | B2 * | 12/2007 | Moos | G01V 1/44 73/152.22 |
| 9,222,346 | B1 * | 12/2015 | Walls | E21B 43/003 |
| 9,982,523 | B2 * | 5/2018 | Ciezobka | E21B 43/26 |
| 10,107,081 | B2 * | 10/2018 | Paulsen | E21B 47/00 |
| 10,641,090 | B2 * | 5/2020 | Felkl | E21B 43/26 |
| 11,193,361 | B1 * | 12/2021 | Yeung | E21B 43/2607 |
| 2004/0256097 | A1 | 12/2004 | Byrd et al. | |
| 2013/0161016 | A1 | 6/2013 | Loree et al. | |
| 2013/0312973 | A1 | 11/2013 | Teichrob | |
| 2014/0096950 | A1 | 4/2014 | Pyecroft et al. | |
| 2014/0357893 | A1 * | 12/2014 | Peters | E21B 43/16 423/396 |
| 2016/0053611 | A1 | 2/2016 | Moos et al. | |
| 2016/0061016 | A1 | 3/2016 | Ciezobka et al. | |
| 2016/0097260 | A1 | 4/2016 | Tolman et al. | |
| 2016/0230515 | A1 | 8/2016 | Hunter et al. | |
| 2017/0159404 | A1 | 6/2017 | Sewell | |
| 2017/0284181 | A1 | 10/2017 | Ciezobka et al. | |
| 2017/0335644 | A1 | 11/2017 | Ciezobka | |

OTHER PUBLICATIONS

International Search Report and Written Opinion issued in related PCT Application No. PCT/US2018/043037 dated Apr. 16, 2019, 11 pages.

* cited by examiner

STIMULATION TREATMENT USING ACCURATE COLLISION TIMING OF PRESSURE PULSES OR WAVES

CROSS-REFERENCE TO RELATED APPLICATION

The present application is a U.S. National Stage Application of International Application No. PCT/US2018/043037 filed Jul. 20, 2018, which is incorporated herein by reference in its entirety for all purposes.

TECHNICAL FIELD

The present disclosure relates generally to systems and methods for servicing a wellbore, and more particularly, to improving and enabling effective stimulation treatment.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Hydraulic stimulation or fracturing may be used to stimulate the production of hydrocarbons from subterranean formations penetrated by a wellbore. A fluid may be pumped through the wellbore and injected into a zone of a subterranean formation to be stimulated at a rate and pressure such that fractures are formed and extended into the subterranean formation. In many regions, long horizontal wellbores are beneficial for the production of hydrocarbons from a formation. These horizontal wells are completed in multiple stages with any given stage be several hundreds of feet or more long. Typically, a wireline or coiled tubing is run in the wellbore that includes a perforating tool and a plug below the perforating tool. The perforating tool is actuated or fired to form one or more perforations and then the wireline or tubing string is retrieved from the wellbore. A stimulation fluid is then pumped or injected into the wellbore to increase the fracture of the perforation into the formation. The process is repeated for each stage of the wellbore. As the length of the stage affects maximization of the production of hydrocarbons within the formation, the length of the stages may be kept at a minimum. That is, generally it is effective to treat a very long stage. As a result, the wireline with the perforating tool and plug must be lowered and retracted several times, perhaps hundreds of times, to treat a wellbore. Such a process is inefficient, increases costs and time to complete an operation, such as a hydrocarbon exploration, production, recovery or services operation. Thus, a need exists for an economically feasible technology that provides stimulation treatment for multiple longer stages in a wellbore so as to reduce costs and time of the operation.

BRIEF DESCRIPTION OF DRAWINGS

Some specific exemplary embodiments of the disclosure may be understood by referring, in part, to the following description and the accompanying drawings.

Figure 1A:
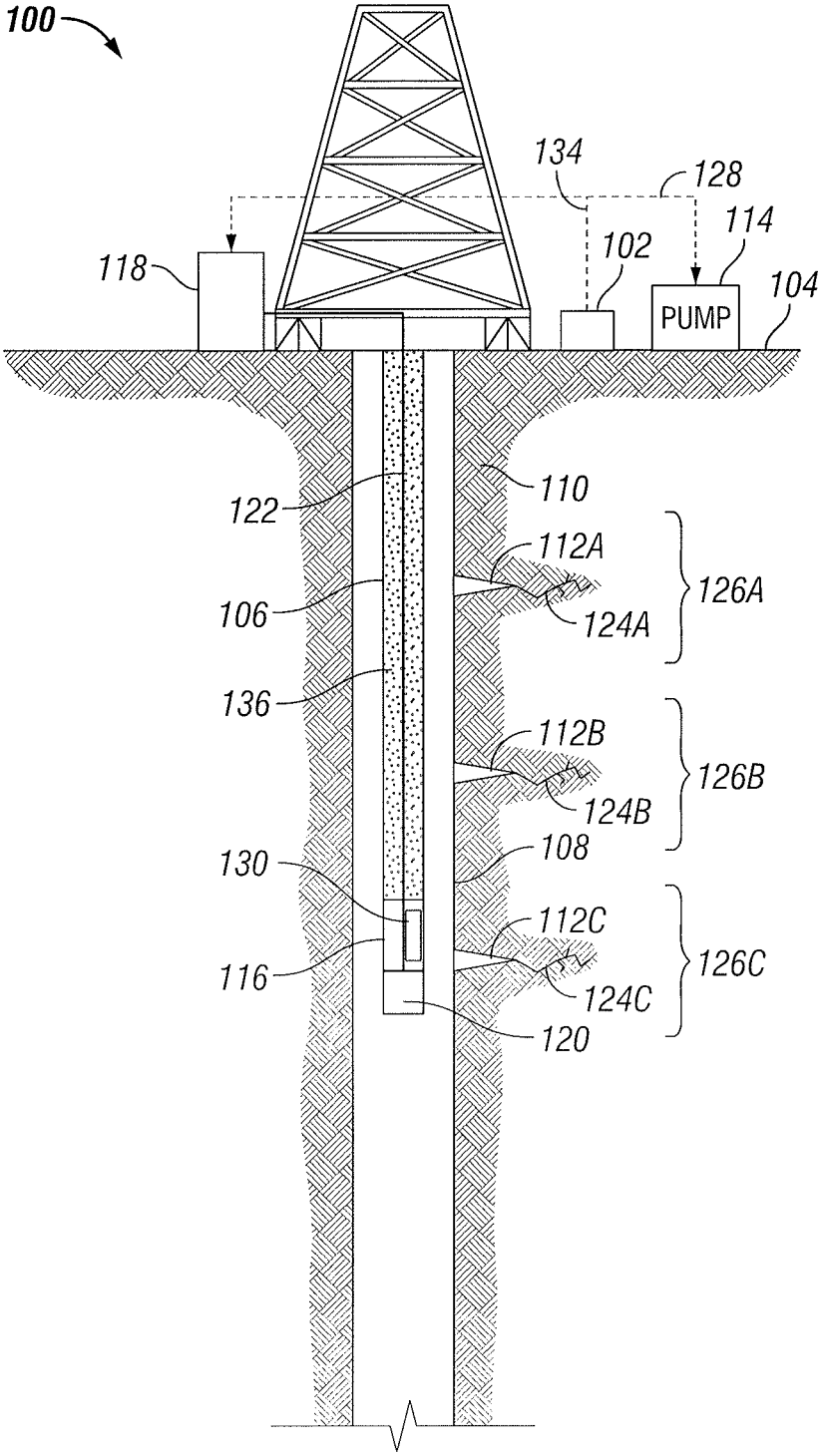
FIG. 1A is a cross-sectional schematic diagram depicting an example of a wellbore environment for utilization of a stimulation treatment system, according to one aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to servicing a wellbore and more particularly to improving and enabling effective stimulation treatment of longer stages or intervals with more perforation clusters in a formation for hydrocarbon recovery and production. In general, however, other applications could include any situations in wellbore servicing where surface pressurization is beneficial. Colliding pressure pulses or waves in a target location are leveraged and the placement of these colliding pressure pulses or waves is controlled along the perforated stage interval in a wellbore. One or more pressure pulses or waves may be initiated with pumping surface techniques and timed such that subsequent pulses or waves collide to effectively stimulate one or more perforations at a specified stage or interval. By knowing the time required for a generated first pulse or wave to propagate downhole and bounce off a termination point (such as a plug or borehole endpoint), a subsequent pulse or wave can be generated to collide with the first pulse or wave at a specified or predetermined location in the wellbore. In this way, specified stages may be perforated as required during a single run of the perforating system downhole with the perforations being expanded by the subsequent collision of generated pulses or waves at specified locations. Performing stimulation treatments in this way increases the efficiency of hydrocarbon exploration, production, recovery or services operation by decreasing the time and costs required to complete the operation.

In one or more aspects of the present disclosure, a well site operation may utilize an information handling system to control one or more operations including, but not limited to, a motor or powertrain, a downstream pressurized fluid system, or both. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1a" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as wellbore or borehole construction for river crossing tunneling and other such tunneling wellbores for near surface construction purposes or wellbore u-tube pipelines used for the transportation of fluids such as hydrocarbons. Embodiments described below with respect to one implementation are not intended to be limiting.

Various aspects of the present disclosure may be implemented in various environments. For example, FIG. 1A is a cross-sectional schematic diagram depicting an example of a wellbore environment 100 for utilization of a stimulation treatment system, according to one aspect of the present disclosure. While FIG. 1 illustrates an onshore environment, the present disclosure contemplates an offshore environment. While FIG. 1 illustrates a substantially vertical wellbore 108, the present disclosure contemplates that any wellbore shape including but not limited to vertical, horizontal, curved or any angle of deviation. The wellbore environment 100 includes a casing string 106 that extends below the surface 104 and into a wellbore 108. The wellbore 108 may extend through subterranean formation 110 in the earth adjacent to the wellbore 108.

The wellbore 108 may be divided into one or more stages for stimulation treatment, for example, stages 126A, 126B and 126C, collectively referred to as stages 126. Each stage 126 may be any length and may be separated from any one or more other stages 126 by any distance. The subterranean formation 110 may include one or more perforations or openings associated with the one or more stages 126, for example, perforation 112A associated with stage 126A, perforation 112B associated with stage 126B and perforation 112C associated with stage 126 C. While only a single perforation 112 is illustrated associated with each stage 126, the present disclosure contemplates any one or more perforations 112 associated with any one or more stages 126. The present disclosure also contemplates that the number or quantity of perforations 112 associated with each stage 126 may differ or vary and that the interval and spacing of one or more perforations 112 within any stage 126 may vary. The perforations 112A, 112B and 112C are referred to generally herein as perforations 112. Each perforation 112, may be extended or fractured deeper into the formation 110, for example, perforation 112A may be extended as shown by fracture 124A, perforation 112B may be extended as shown by fracture 124B and perforation 112C may be extended as shown by fracture 124C. Fractures 124A, 124B and 124C are collectively referred to herein as fracture 124. In one or more embodiments, the perforation 112 or the fracture 124 may be a separation of the subterranean formations 110 forming a fissure or crevice in the subterranean formations 110. Any one or more fractures 112 may serve as a path for the production of hydrocarbons from subterranean reservoirs.

A wireline or coiled tubing 122 may be disposed or positioned within the wellbore 108. Any one or more of perforating tool 116, a termination point or isolator 120 and any other downhole tool may be positioned or disposed downhole via the wireline or coiled tubing 122. For example, wireline or coiled tubing 122 may couple to a perforating tool 116 to provide power, communications or both to the perforating tool 116. In one or more embodiments a termination point or isolator 120 may comprise a plug, a barrier, a bottom of the wellbore 108, or any other termination point or isolator that sections off one or more portions of a wellbore 108. In one or more embodiments, a termination point or isolator 120 may be coupled to the perforating tool 116 or may be set at a location in the wellbore 108 prior to positioning the perforating tool 116 within the wellbore 108. In one or more embodiments, the perforating tool 116 comprises one or more explosive charges 130. Upon receiving a command or actuation, the perforating tool 116 detonates one or more explosive charges 130 to create one or more perforations 112. In one or more embodiments, the wireline or coiled tubing 122 retracts to retrieve the perforation tool 116, the termination point or isolator 120 or both. In one or more embodiments, the perforation tool 116, the termination point or isolator 120 or both may be disengaged from the wireline or coiled tubing 122 and released into the wellbore 108 prior to retracting the wireline or coiled tubing 122.

A pump 114 is positioned or disposed at a surface 104 proximate to the wellbore 108. Pump 114 couples to conduit 128 via conduit 134. Conduit 128 fluidically couples to the wellbore 108. The pump 114 pumps one or more fluids, for example, fluid 136 of FIG. 1B, via conduit 128 into the wellbore 108. An injection pumping system 102 may couple to conduit 128 to inject pressure pulses or waves via the one or more fluids pumped by pump 114 through conduit 128 to extend or fracture one or more perforations 112, for example, to form one or more fractures 124.

A control unit 118 may couple to any one or more devices, components or equipment at the environment 100. Control unit 118 may monitor or control any one or more devices, components or equipment at the environment 100. For example, control unit 118 may communicate a command via the wireline or coiled tubing 122 to the perforating tool 116 to cause the perforating tool 116 to detonate one or more explosive charges 130. In one or more embodiments, control unit 118 controls injection pump 102. For example, control unit 118 may transmit a command to injection pump 102 that causes injection pump 102 to generate one or more pressure pulses or waves at one or more timed intervals or in a specified sequence. In one or more embodiments, control unit 118 may comprise one or more information handling systems, for example, information handling system 500 of FIG. 5.

Figure 1B:
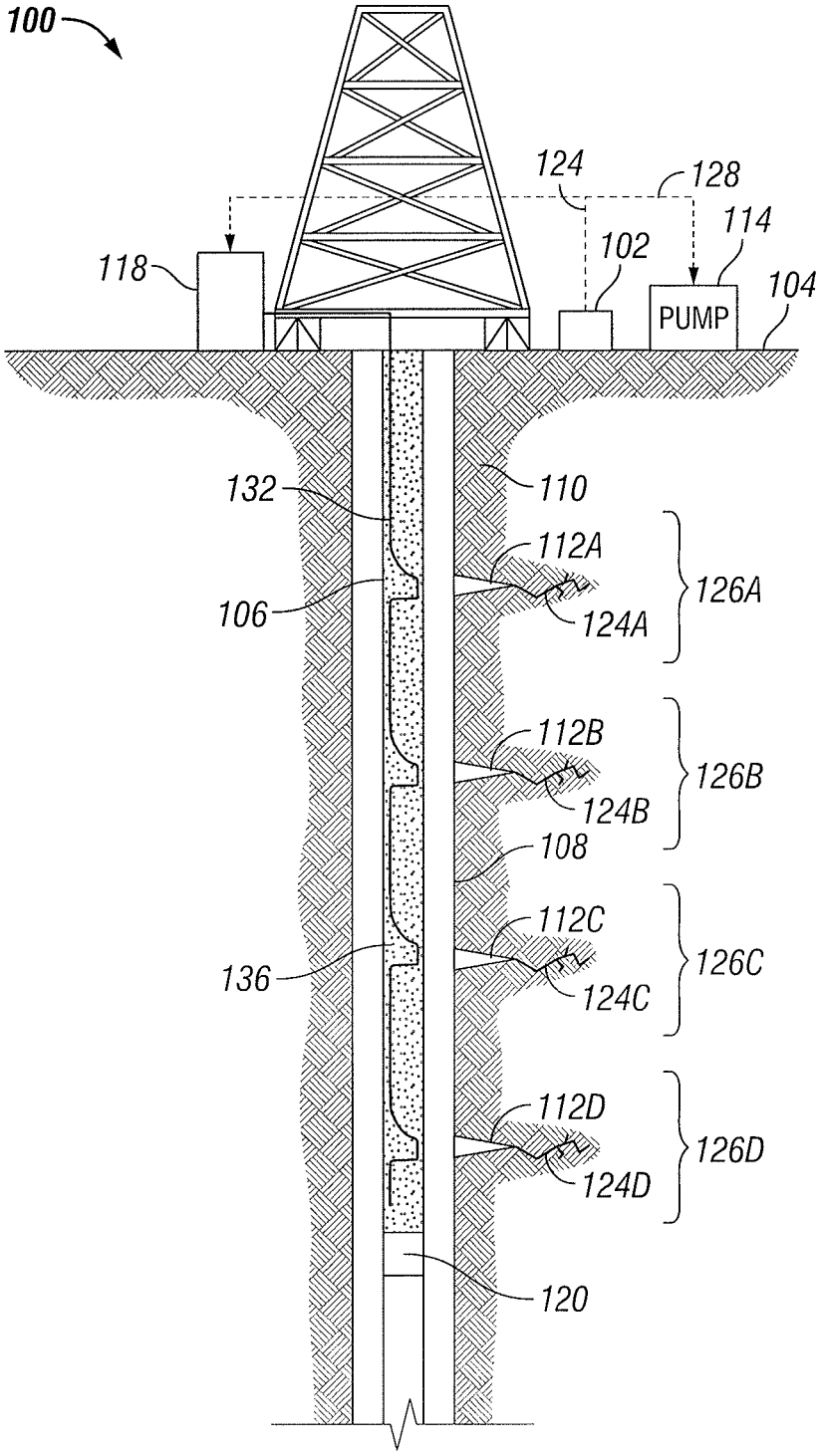
FIG. 1B is a cross-sectional schematic diagram depicting an example of a wellbore environment for utilization of a stimulation treatment system, according to one aspects of the present disclosure.

FIG. 1B is a cross-sectional schematic diagram depicting an example of a wellbore environment 100 for utilization of a stimulation treatment system, according to one aspects of the present disclosure. FIG. 1B is similar to FIG. 1A except that the perforation tool 116 has been retrieved from the wellbore 108 after, for example, creation of the one or more perforations 112 at the one or more stages 126. The injection pump 102 may generate a pressure pulse or wave 132 in a fluid 136 pumped into the wellbore 108 by pump 114 to expand fracture 112C of stage 126C. While only one perforation 112C is illustrated with stage 126C, the present disclosure contemplates any number of perforations 112C associated with stage 126C. In one or more embodiments, fluid 136 comprises a stimulation or fracturing fluid or any other type of fluid used downhole.

Figure 2:
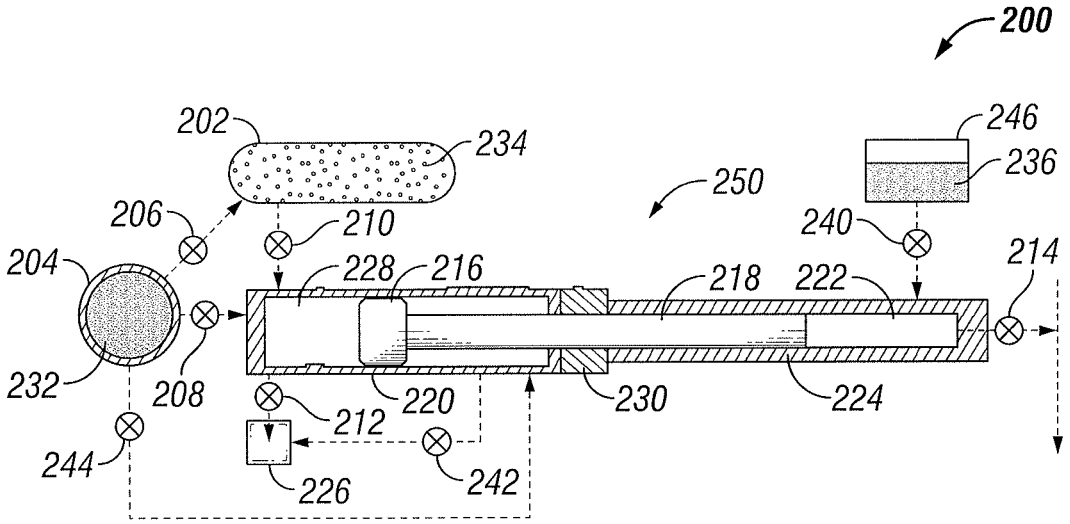
FIG. 2 is a diagram illustrating an injection pumping system, according to one or more aspects of the present disclosure.

FIG. 2 is a diagram illustrating an injection pumping system 200, according to one or more aspects of the present disclosure. To generate substantial pressure pulses or waves, sudden flow increases are required. While a general pump, such as pump 114 of FIG. 1A and FIG. 1B may be used, such pumps generally cannot be on-line rapidly and thus do not produce a good quality pulse but rather produce a gradual rise and a gradual fall waveform. A pressure pulse or wave, such as pressure pulse or wave 132, for example, a water hammer, travels at a high speed approximate to or at the speed of sound. The injection pumping system 200 may be used to generate a pressure pulse or wave 132.

In one or more embodiments, injection pumping system 200 may comprise an accumulator 202 (such as a high pressure accumulator), a hydraulic pump 204, one or more valves, for example, valve 206, 208, 210, 212 and 214, and a piston assembly 250. Piston assembly 250 may comprise a first section 220 and a second section 224. A piston 218 may actuate to reciprocate between the first section 220 and the second section 224. A second section cavity 222 may be created when the piston 218 is withdrawn into the first section 220 and a first section cavity 228 may be created when the piston 218 is projected into the second section 224. Connector 230 couples the first section 220 and the second section 224 together. In one or more embodiments, the first section 220 and the second section 224 are a single piece and connector 230 is not required. The accumulator 202 provides a rapid high pressure pulse into the conduit 128. In one or more embodiments, when the accumulator 202 provides the specified or required pressure the piston 218 is a separator, for example, a moving wall that separates the "clean" control fluid 234 received from the accumulator 202 and the "dirty" stimulation fluid 236 from stimulation fluid tank 246. The "clean" control fluid 234 may comprise any one or more of water, hydraulic oil, antifreeze or any other appropriate control fluid. In one or more embodiments, the pressure supplied by the accumulator 202 is not sufficient to supply the specified or required pressure level or the specified or required pressure level may be too high for the conduit 128. In such an embodiment, the piston 218 may have an additional piston 216. The additional piston 216 may be smaller than the piston 218 or larger than piston 218. As the valve 210 is opened so that "clean" control fluid 234 from accumulator 202 flows into first section cavity 228 so as to pressurize the first section cavity 228 and as the additional piston 216 is larger, the stimulation fluid 236 that is drawn into the second section cavity 222 by the piston 218 amplifies the pressure towards the conduit 128. When the additional piston 216 is smaller than the piston 218, the pressure towards the conduit 128 is lower.

In one or more embodiments, prior to operation of the injection pump system 200, valve 240 (a fluid intake valve), which couples the piston assembly 250 to the stimulation fluid tank 246, may be opened to allow the second section cavity 222 to fill with stimulation fluid 236. Prior to filling the second section cavity 222 with the stimulation fluid 236, the piston 218 is pushed all the way to the right or all the way into the second section cavity 222 by closing valve 212 and opening valve 208, which fills the first section cavity 228 only if the return line valve 242 allows the stimulation fluid 236 from the second section cavity 222 to be relieved into the tank 226. After the piston 218 is fully extended, the second section cavity 222 may be filled with the stimulation fluid 236 from the stimulation fluid tank 246 by opening valve 240, closing valve 208, opening valve 212 and opening valve 244.

In one or more embodiments, stimulation fluid 236 that has been drawn into the second section cavity 222 is directed or forced into conduit 128 when valve 214 is opened. Valve 214 may be opened and close successively, rapidly or in short bursts to increase flow of surface fluids downhole. For example, an open and close sequence of valve 214 may force stimulation fluid 236 into conduit 128 to increase the flow of fluid 136 pumped by pump 114 as illustrated in FIG. 1 which creates a pressure spike or a pressure pulse or wave, such as pressure pulse or wave 132. To create the pressure spike, valve 214 is opened after closure of valves 208, 240, 212, 244 and opening of valves 210 and 206. In one or more embodiments, valve 206 is not opened unless an increase in pressure of the flow of fluid 136 is required for the given operation.

After the pressure spike has been created by the sequence of valve openings and closures and displacement or stroke of piston 218, valve 214 is quickly or rapidly closed and hydraulic fluid 232 is redirected from flowing from the accumulator 202 to the first cavity section 222 by closing valve 210 and opening valve 244 and valve 212. Valve 206 is opened to charge the accumulator 202 with the hydraulic fluid 232 so that the accumulator 202 is ready for a next stage of stimulation or to create an additional pressure spike. Any one or more of the valves discussed must be opened and closed in a rapid or short sequence as the additional pressure spike may be required within a short time frame. In one or more embodiments, the injection pumping system 200 may comprise a plurality of accumulators 202. The number of accumulators 202 may be based on any one or parameters including, but not limited to, the charge time of any one or more of the accumulators 202, a time sequence for generation of one or more pressure pulses or waves, a particular stimulation operation (for example, the amount of fluid pressure required, the number of stages requiring treatment, the number of perforations 112 in a stage 126, any other criteria or factor associated with the stimulation operation, or any combination thereof), type of stimulation fluid 436 and any other parameter. For example, an operation may require a pressure spike sequence where the plurality of accumulators 202 are activated one after the other so as to generate a required plurality of pressure pulses or waves.

In one or more embodiments, valve 214 may couple to any one or more other components or sources of fluid. Valve 206, accumulator valve, is coupled to the hydraulic pump 204 and the accumulator 202 and is opened to allow the hydraulic pump 204 to fill the accumulator 202 with a pressurizing fluid 232 until a specified fluid pressure for the pressurizing fluid 232 is reached. For example, the specified fluid pressure may be determined or based on the required total pressure for a pressure pulse or wave with the ratio of the area of piston 218 and additional piston 216 if present.

Figure 3A:
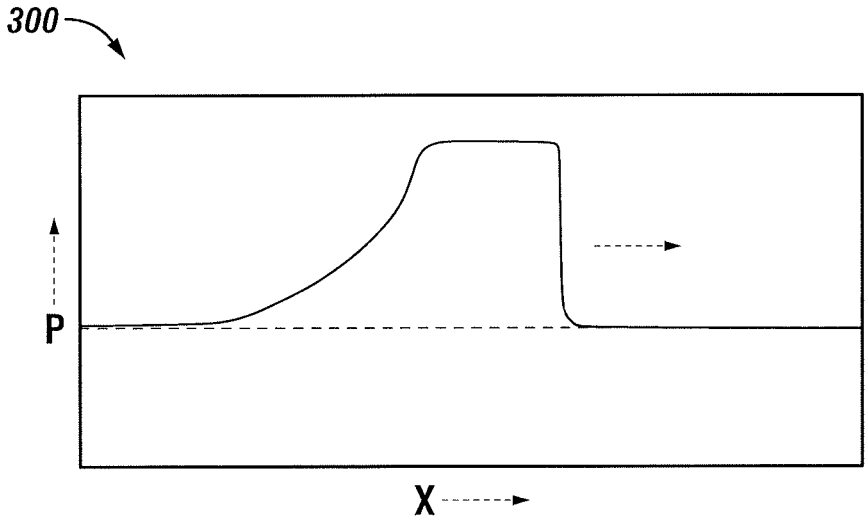
FIG. 3A is a diagram illustrating a pressure pulse or wave, according to one or more aspects of the present disclosure.

FIG. 3A is a diagram illustrating a pressure pulse or wave 300, according to one or more aspects of the present disclosure. Pressure pulse or wave 132 of FIG. 1B may be similar to or the same as pressure pulse or wave 300 of FIG. 3A. The reciprocation of piston 218 of FIG. 2 may cause the generation of pressure pulse or wave 300. Pressure pulse or wave 300 propagates through a well fluid, for example, well fluid 136 of FIG. 1B. As illustrated in FIG. 3A, pressure pulse or wave 132 ramps to a peak pressure as illustrated by the label for the vertical axis, stabilizes for a period of time or a distance and drops to a minimum pressure. In one or more embodiments, the pressure pulse or wave 300 immediately or substantially immediately decreases from a peak pressure to a minimum pressure. The pressure pulse or wave 300 propagates through the fluid 136 as illustrated by the label for the horizontal axis. The pressure pulse or wave 300 is at a pressure above the average treatment pumping pressure for the wellbore 108.

Figure 3B:
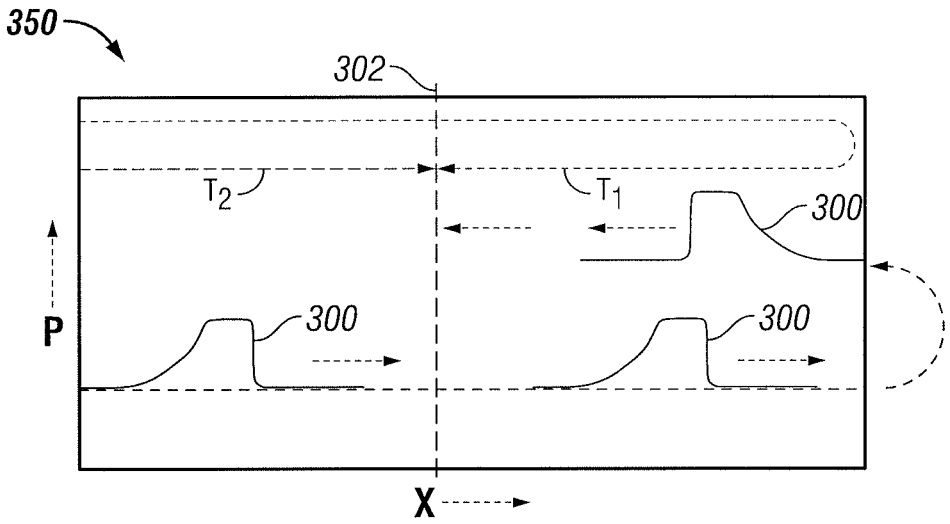
FIG. 3B is a diagram illustrating propagation of a pressure pulse or wave environment, according to one or more aspects of the present disclosure.

FIG. 3B is a diagram illustrating a propagation of a pressure pulse or wave environment 350, according to one or more aspects of the present disclosure. As illustrated in FIG. 3B, a pressure pulse or wave 300 propagates in a fluid 136 of a wellbore 108 and is reflected at a termination point or isolator, for example, a termination point or isolator 120 of FIG. 1A and FIG. 1B. In one or more embodiments, a stage 126 comprising one or more perforations 112 may be located at or about a location 302. For a collision of pressure pulses or waves to occur at or about location 302, a reflection time $T_1$ for pressure pulse or wave 300 to travel or propagate to or about location 302 must be determined. Reflection time $T_1$ represents the time that a pressure pulse or wave takes to travel from the surface 104 down the wellbore 108 and reflect or bounce off a termination point or isolator 120 and travel back up the wellbore 108 to location 302. Reflection time $T_1$ based, at least in part, on the speed of sound as a function of pressure and fluid type as the speed of sound may not be constant throughout the length of the wellbore 108. For example, the speed of sound along any portion or at any position within the wellbore 108 is based, at least in part, on the fluid type, the amount of pressure at a particular depth, temperature, mixture of the fluid at a particular depth or time, or any other downhole condition or variable.

Figure 3C:
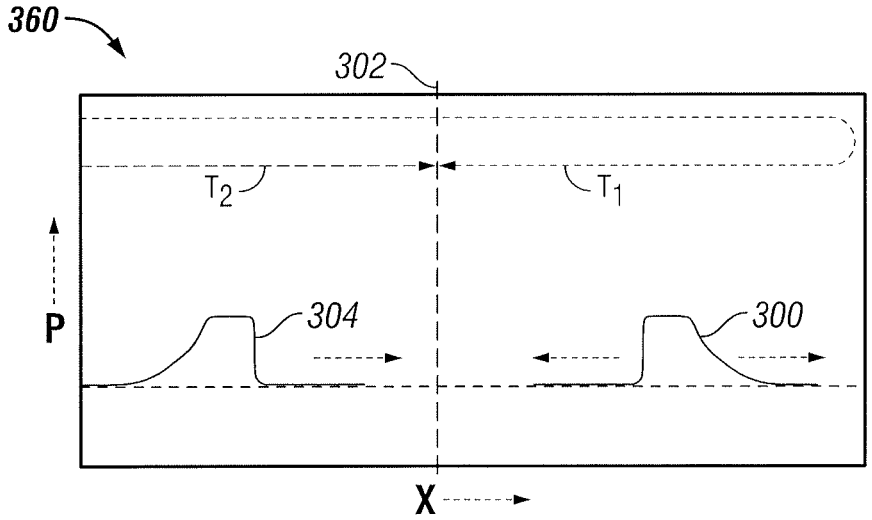
FIG. 3C is a diagram illustrating a collision intersection of pressure pulses or waves in an environment, according to one or more aspects of the present disclosure.

FIG. 3C is a diagram illustrating a collision intersection of one or more pressure pulses or waves in an environment 360, according to one or more aspects of the present disclosure. The time $T_2$ for a subsequent pressure pulse or wave 304 to propagate from the surface 104 through a fluid 136 of wellbore 108 to at or about location 302 may also be determined based, at least in part, on the speed of sound as a function of pressure and fluid type. The difference $T_1$ and $T_2$ results in a time $T_3$. A collision occurs at predetermined or specified location 302 which creates a pressure spike to fracture or extend one or more perforations at location 302 when pressure pulse or wave 304 is generated at a time $T_3$ after generation of the pressure pulse or wave 300. In one or more embodiments, any number of initial pressure pulses or waves 300 may be generated to propagate in a fluid 136 of a wellbore 108 and any number of subsequent pressure pulses or waves 304 may be generated to collide with a corresponding initial pressure pulse or wave 300 at or about one or more locations 302. The timing for $T_1$ and $T_2$ may be modified, altered or manipulated by, for example, increasing the pressure, altering, modifying or changing the fluid 136, increasing or decreasing the magnitude of the pressure pulse or wave, or any combination thereof. In this manner, each stage that includes one or more perforations can be treated preferentially, independently or both to propagate or extend fractures into the surrounding formation.

Figure 3D:
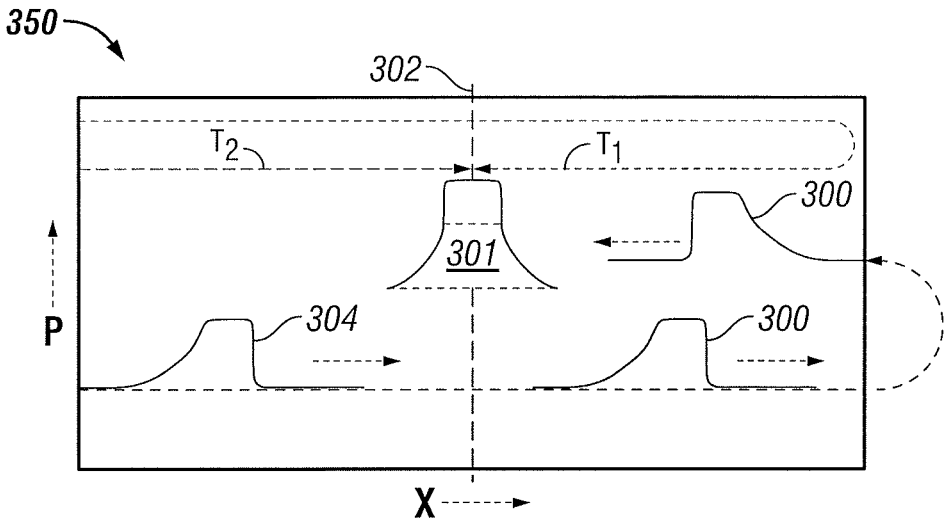
FIG. 3D is a diagram illustrating a resulting collision wave of pressure pulses or waves in an environment, according to one or more aspects of the present disclosure.

FIG. 3D is a diagram illustrating a resulting collision wave of pressure pulses or waves in an environment 370, according to one or more aspects of the present disclosure. The collision of pressure pulse or wave 300 and pressure pulse or wave 304 at intersection 302 produces the resulting collision wave 301. The resulting collision wave 301 causes a perforation 112 to be extended to create a fracture 124 as illustrated in FIGS. 1A and 1B. The environments 350, 360 and 370 of FIGS. 3B, 3C and 3D represent different stages of the propagation of pressure or pulses or waves in a wellbore, for example, wellbore 108. The total pressure of the resulting collision wave 301 is the pressure of the original pressure of the stimulation treatment operation due to pumping of stimulation fluid into the wellbore summed with the pressure from the collision or the pressure associated with the resulting collision wave 301.

Figure 3E:
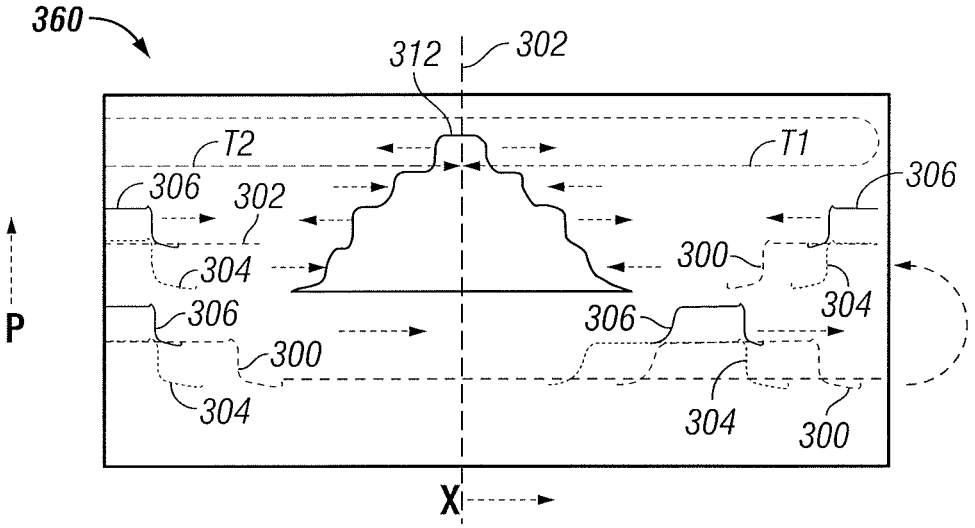
FIG. 3E is a diagram illustrating a resulting collision wave of complex pressure pulses or waves in an environment, according to one or more aspects of the present disclosure.

FIG. 3E is a diagram illustrating a resulting collision wave of complex pressure pulses or waves in an environment, according to one or more aspects of the present disclosure. In one or more embodiments, the initial pressure pulse or wave 300 may require a length of time to pressurize such that the pressure pulse or wave 304 must be generated before the initial pressure pulse or wave 300 is completely generated such as when the time T2 is shorter than the wavelength of the initial pressure pulse or wave 300. For example, the pressure pulse or wave 304 may "ride" the initial pressure pulse or wave 300 which requires that the pressure generated is higher than the pressure associated with any given pressure pulse or wave. In one or more embodiments, the pressure associated with each pressure pulse or wave may be reduced to adjust the timing for T1, T2 or both. As illustrated in FIG. 3E, subsequent pressure pulse or wave 304 may be generated prior to pressure pulse or wave 300 being completely generated. The length or duration of pressure pulse or wave 300 and subsequent pressure pulse or wave 304 may be longer than the time for these pressure pulses or waves to bounce or reflect off of termination point or isolator 120 such that the resulting collision resembles the stimulation pulse 312. The peak pressure of stimulation pulse 312 is the result of the beginning of the combined pressure pulse or wave 306 of the initial pressure pulse or wave 300 and the subsequent pressure or pulse or wave 304 colliding with end of the combined pressure pulse or wave 306 such that a stair-stepped collision occurs. For example, an operation with a location 302 for stimulation at or near the termination point or isolator 120 where the termination point or isolator 120 is at a depth close to the surface such that the speed of sound along the wellbore 108 to the depth permits an initial pressure pulse or wave 300 to traverse to the depth before generation of the initial pressure pulse or wave 300 is completed and such that the subsequent pressure pulse or wave 304 must ride the initial pressure pulse or wave 300 may require a stimulation pulse 312 as depicted in FIG. 3E. In one or more embodiments, subsequent pressure pulse or wave 304 may overlap or ride the initial pressure pulse or wave 300 for any duration.

Pressure pulses or waves (or water-hammer) travel at a high speed generally equal to or about the speed of sound. For two pressure pulses or waves to collide at a specific location requires that the speed of sound throughout the wellbore be known. However, the speed of sound may vary substantially throughout the wellbore such that the speed of sound may differ at one or more locations within the wellbore. At low pressure, the speed of sound can generally be assumed to be constant. In a wellbore, such an assumption may not be appropriate. Further, the type of fluid injected into the wellbore may also affect the speed of sound. Thus, each fluid used in the treatment or stimulation of a wellbore must be tested under varying pressure, temperature, any other downhole factor or criteria, or any combination thereof to determine the speed of sound at different locations within a wellbore to ensure collision at the desired, specified or predetermined location.

Figure 4:
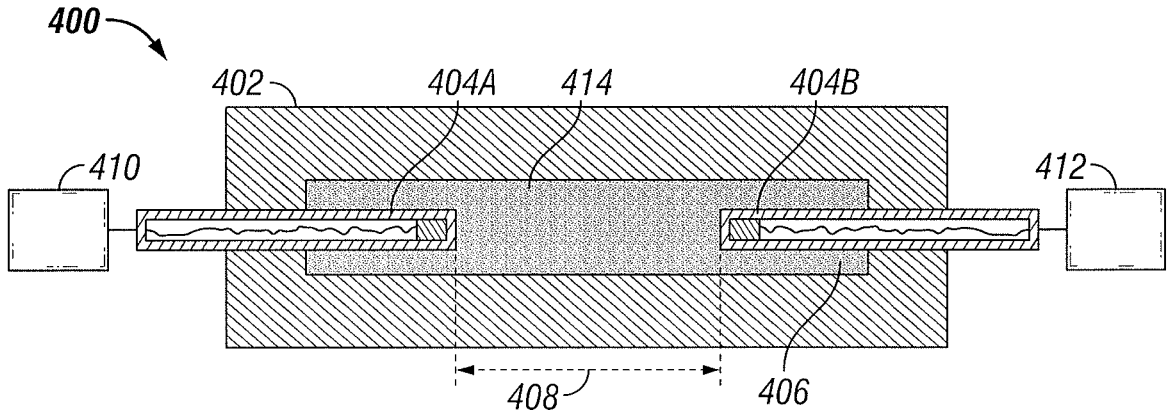
FIG. 4 is a diagram illustrating an ultra-high pressure sound velocity measurement system, according to one or more aspects of the present disclosure.

FIG. 4 is a diagram illustrating a measurement system 400, according to one or more aspects of the present disclosure. A container 402 for varying and maintaining pressure comprises a first transducer 404A and a second transducer 404B, collectively transducers 404. In one or more embodiments, first transducer 404A comprises a wave generator or wave transmitter and second transducer 404B comprises a wave receiver. A fluid 406 is disposed or injected into a chamber 414 of the container 402 and surrounds the transducers 404. The first transducer 404A is coupled to a pressure pulse generator 410. Transducer 404B is coupled to a measurement device 412. In one or more embodiments, any one or more of pressure pulse generator 410 and measurement device 412 may comprise an information handling system, such as a time measuring information handling system 500 of FIG. 5.

The container 402 may be filled with a first fluid 406 and pressurized to a first pressure. A first pressure pulse or wave may be generated to travel at the speed of sound by the pulse generator 410 and propagated into the fluid 406 via transducer 404A. The transducer 404B triggers on arrival of the first pressure pulse or wave. The information from the transducer 404B is communicated to the measurement device 412. As the distance 408 travelled by the first pressure pulse or wave is known, the speed of sound of the first pressure pulse or wave through the fluid 406 may be determined by the measurement device 412. For example, speed of sound may be determined using a high velocity counter measurement device which is triggered when the pressure pulse or wave is generated and received. A second and one or more subsequent pressure pulses or waves may be generated to determine the speed of sound at any one or more pressures, through one or more fluids and any combination of pressures and fluids. In or more embodiments, the chamber 414 may be disposed or positioned horizontally, vertically or at any deviation. In one or more embodiments, the fluid 406 may comprise proppants and may be continuously pumped into the chamber 414. The speed of sound as a function of pressure data collected from the measurement system 400 may be graphed or charted to determine any necessary error corrections. The data is used to determine the necessary timings required, for example, as discussed above with respect to FIGS. 3A-3E, to collide multiple pressure pulses or waves to extend one or more perforations or fractures at one or more stages of a wellbore.

Figure 5:
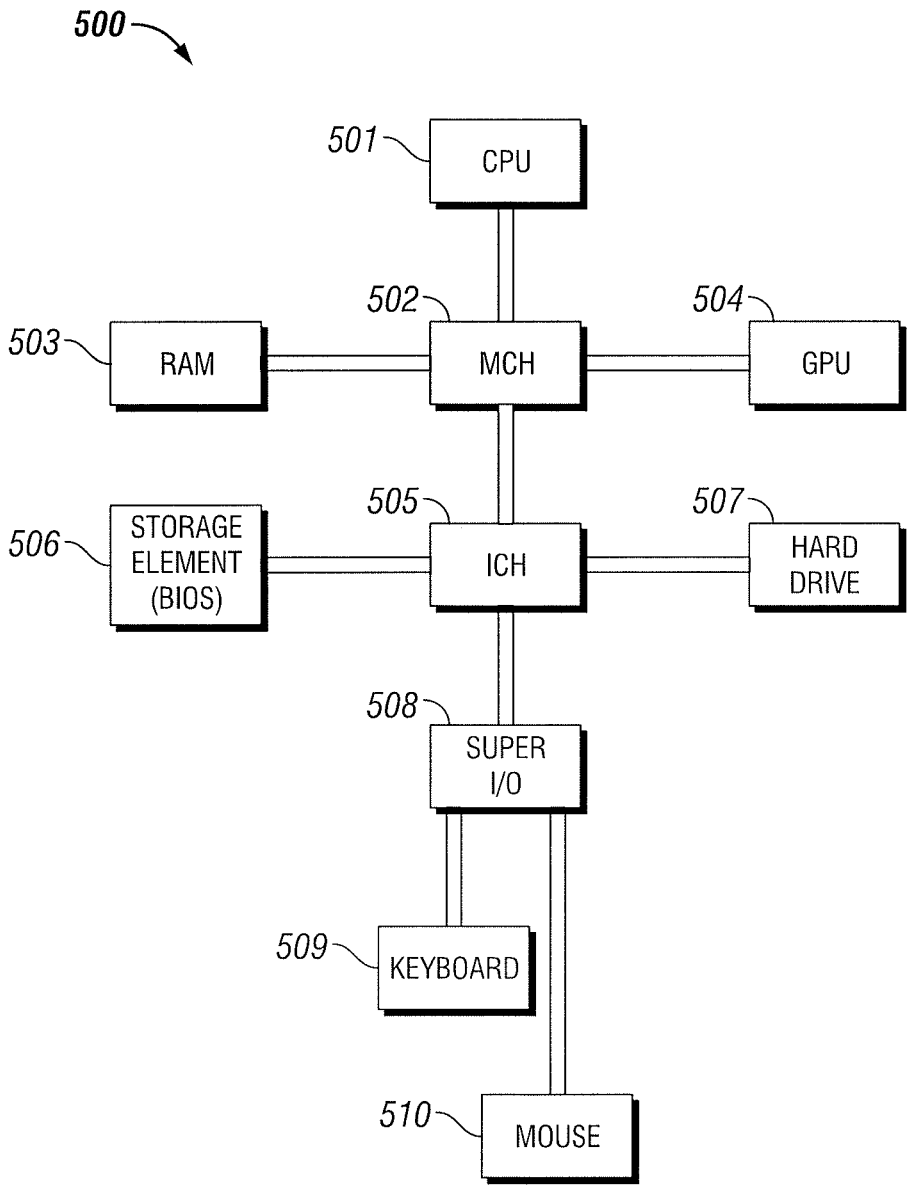
FIG. 5 is a diagram illustrating an example information handling system, according to one or more aspects of the present disclosure.

FIG. 5 is a diagram illustrating an example information handling system 500, according to aspects of the present disclosure. Any one or more of control unit 118 and the measurement device 412 may take a form similar to the information handling system 500. A processor or central processing unit (CPU) 501 of the information handling system 500 is communicatively coupled to a memory controller hub or north bridge 502. The processor 501 may include, for example a microprocessor, microcontroller, digital signal processor (DSP), application specific integrated circuit (ASIC), or any other digital or analog circuitry configured to interpret and/or execute program instructions and/or process data. Processor 501 may be configured to interpret and/or execute program instructions or other data retrieved and stored in any memory such as memory 503 or hard drive 507. Program instructions or other data may constitute portions of a software or application for carrying out one or more methods described herein. Memory 503 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software program or an application may be retrieved and stored in memory 503 for execution by processor 501.

Modifications, additions, or omissions may be made to FIG. 5 without departing from the scope of the present disclosure. For example, FIG. 5 shows a particular configuration of components of information handling system 500. However, any suitable configurations of components may be used. For example, components of information handling system 500 may be implemented either as physical or logical components. Furthermore, in some embodiments, functionality associated with components of information handling system 500 may be implemented in special purpose circuits or components. In other embodiments, functionality associated with components of information handling system 500 may be implemented in configurable general purpose circuit or components. For example, components of information handling system 400 may be implemented by configured computer program instructions.

Memory controller hub (MCH) 502 may include a memory controller for directing information to or from various system memory components within the information handling system 500, such as memory 503, storage element 506, and hard drive 507. The memory controller hub 502 may be coupled to memory 503 and a graphics processing unit 504. Memory controller hub 502 may also be coupled to an I/O controller hub (ICH) or south bridge 505. I/O hub 505 is coupled to storage elements of the information handling system 500, including a storage element 506, which may comprise a flash ROM that includes a basic input/output system (BIOS) of the computer system. I/O hub 505 is also coupled to the hard drive 507 of the information handling system 500. I/O hub 505 may also be coupled to a Super I/O chip 508, which is itself coupled to several of the I/O ports of the computer system, including keyboard 509 and mouse 510.

Figure 6:
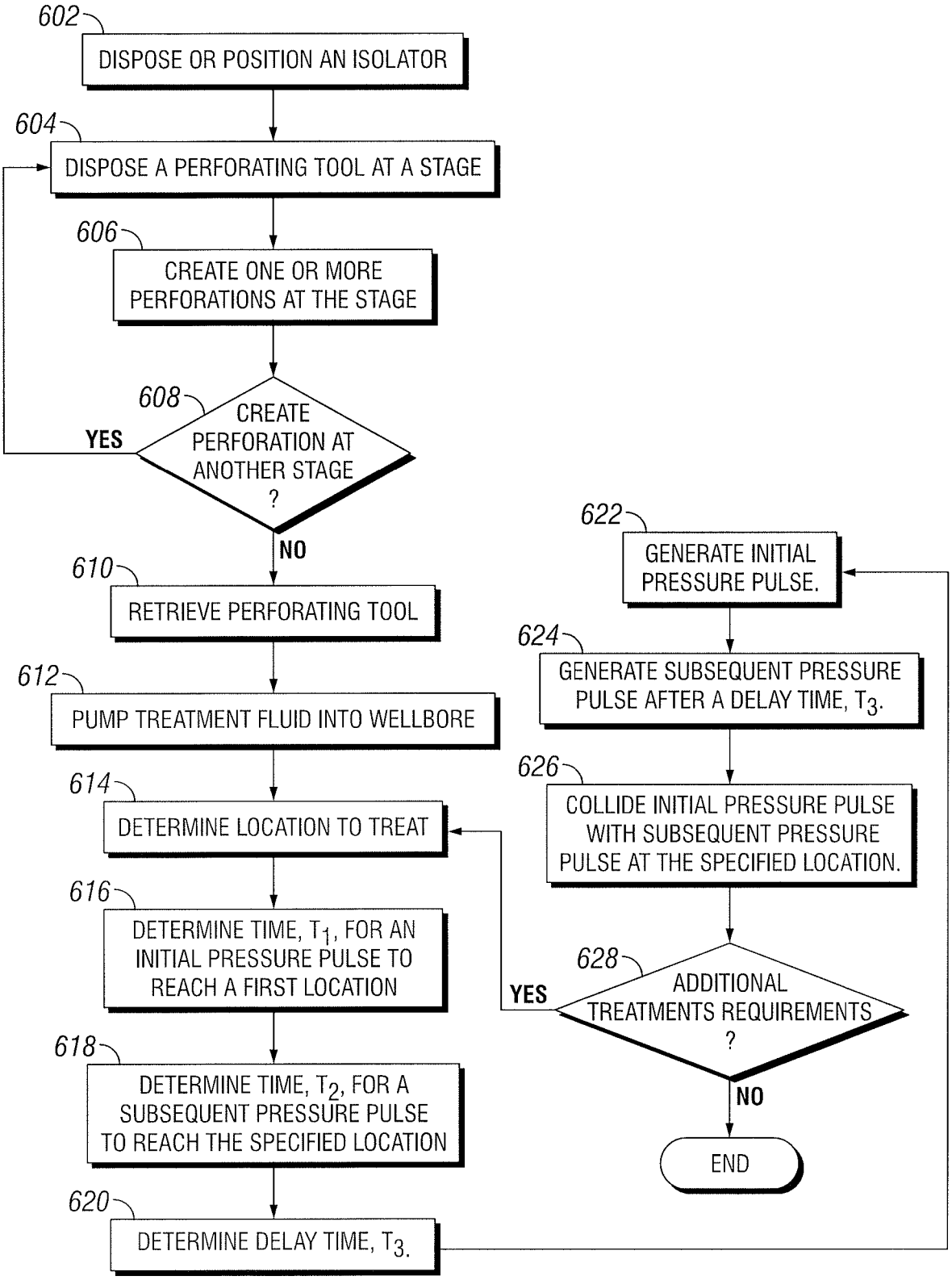
FIG. 6 is flowchart illustrating a stimulation treatment, according to one or more aspects of the present disclosure.

FIG. 6 is a flowchart illustrating a stimulation treatment, according to one or more aspects of the present disclosure. Generally, to treat multiple stages of perforations in a wellbore requires repeatedly positioning a termination point or isolator in the wellbore at a required termination point, running a perforating tool in the wellbore at the stage, creating one or more perforations for the stage, retracting the perforating tool, injecting stimulation fluid to fracture or extend the one or more perforations and removing or displacing the termination point or isolator. The entire process must be repeated for each stage. Such a process is costly and time-consuming. The present disclosure provides efficient treatment of multiples stages of a wellbore.

In one or more embodiments, at step 602 a termination point or isolator 120 is disposed or positioned in the wellbore 108 as illustrated in FIG. 1A. At step 604, a perforating tool 116 may be disposed or positioned at a first stage 126, for example, stage 126D, in wellbore 108. The perforating tool 116 may be actuated at step 606 to detonate one or more explosive charges 130 to create one or more perforations 112D at the first stage 126D. At step 608, it is determined if another stage requires creation of one or more perforations. If so, steps 602-606 are repeated. For example, a perforating tool 116 may be disposed or positioned in wellbore 108 at stage 126C and one or more perforations 112C may be created, the perforating tool 116 may be retracted to stage 126B where one or more perforations 112B are created and the perforating tool 116 may be retracted to stage 126A where one or more perforations 112A are created. The present disclosure contemplates that one or more perforations 112 may be created at any one or more stages 126 in any order. If additional stages are not required, the process proceeds to step 608.

At step 610, the perforating tool 116 is removed, retracted, retrieved or otherwise disposed of (for example, the perforating tool 116 may be disconnected from the wireline 122 and allowed to drop to the bottom of the wellbore 108 or may be retrieved from the wellbore 108 for later use). At step 612, treatment fluid such as fluid 136 is pumped into the wellbore 108. One or more perforations 112 at any one or more stages 126 may be extended due to the pressure of the pumped treatment fluid.

At step 614, the location selected for treatment is determined. A location may be a stage 126, a location of one or more perforations 112 within a stage 126 or any other location selected for treatment. Any one or more stages 126 may comprise one or more perforations 112 spaced apart at any interval with each of the one or more perforations 112 spaced apart by a predetermined distance, a random distance, or any other distance. For example, one or more perforations 112 may form a cluster within a stage 126 and any one or more clusters within a stage 126 may be spaced at any interval within the stage 126. The treatment of stages 126 may be predetermined prior to any operation at the site, for example, environment 100, or during any one or more operations at the site. For example, one or more characteristics of the wellbore 108 (such as mineralogy), the formation 110, the fluid 136, the one or more perforations 112, the temperature or pressure at any one or more locations within the wellbore, any other factor, criteria or characteristic, or any combination thereof may alter the speed of sound and thus alter selected of the stage 126 for treatment.

At step 616, the time for an initial pressure pulse or wave to reach a first location is determined. For example, the time $T_1$, as illustrated in FIGS. 3A-3E, for an initial pressure pulse 300 to propagate through a fluid 136 in the wellbore 108 and reflect or bounce off a termination point or isolator 120 and reach a specified or predetermined location 302 is determined. The time $T_1$ may be determined based on speed of sound as a function of pressure and fluid type data obtained, for example, as discussed above with respect to FIG. 4, data collected at the site during one or more operations, any other data, or any combination thereof. The data may be stored in a database or memory of an information handling system, such as information handling system 500 of FIG. 5, that is remote from or located at the site. Similarly, the time $T_2$, as illustrated in FIGS. 3B-3E, for a subsequent pressure pulse or wave 304 to propagate through a fluid 136 of the wellbore 108 to reach location 302 is determined at step 618. At step 620, the delay time, $T_3$, for generation of the subsequent pressure pulse is determined.

At step 622, the initial pressure pulse or wave 300 is generated and propagated via the fluid 136 through the wellbore 108 as discussed above with respect to FIG. 2. The initial pressure pulse or wave 300 may be generated based on any one or more characteristics as discussed above to create a waveform appropriate for the collision at or about the specified location 302 to effectuate fracturing or extension of the one or more perforations at or about the specified location 302. At step 624, after delay time, $T_3$, a subsequent pulse or wave 304 is generated and propagated via the fluid 136 through the wellbore 108 as discussed above with respect to FIG. 2. The subsequent pressure pulse or wave 304 may be generated based on any one or more characteristics as discussed above to create a waveform appropriate for the collision at or about the specified location 302 to effectuate fracturing or extension of the one or more perforations at or about the specified location 302. The initial pressure pulse or wave 300 reflects or bounces off a termination point or isolator 120 and collides with the subsequent pressure pulse or wave 304 at or about the specified location 302 at step 626. The collision creates a pressure spike that extends one or more perforations that are at or about the specified location 302 to create one or more fractures 124 in the formation 110. In one or more embodiments, a stimulation pulse 312 as illustrated in FIG. 3E may be created by generating the subsequent pressure pulse or wave 304 prior to completing generation of the initial pressure pulse or wave 300.

At step 628, it is determined if another location or the same location requires treatment. In one or more embodiments, a location may be within the same stage 126 previously treated, another stage or any other location within the wellbore 108. In one or more embodiments, treatment of the one or more perforations 112 within a stage 126 may require a plurality of collisions of pressure pulses or waves to properly extend or create a fracture 124 at the same location as previously treated. If additional treatments are required, the process repeats steps 614-626 such that each stage 126 or location 302 within the wellbore 108 can be treated preferentially, independently or both. In one or more embodiments, any one or more steps may be performed in any order and one or more steps may be omitted or repeated. In one or more embodiments, the timing of $T_1$ and $T_2$ may be modified or altered as discussed above with respect to FIG. 3C. For example, a subsequent treatment according to the above steps may be performed using a different fluid, at a different pressure, using a different magnitude, or any combination thereof. If it is determined at step 628 that no other treatments are necessarily, the process ends. In one or more embodiments, steps 602-628 may be repeated for another section or portion of the wellbore 108. In one or more embodiments, an operation that requires production of hydrocarbons from the formation 110 may be initiated after completion of any one or more of the above steps.

In one or more embodiments, a method for stimulation treatment of a wellbore in a formation comprises generating, at a first time, a first pressure pulse that propagates through a fluid pumped into the wellbore, generating, at a second time, a second pressure pulse that propagates through the fluid, colliding the first pressure pulse and the second pressure pulse to create a first pressure spike at a first location in the wellbore and creating one or more fractures in the formation by the first pressure spike. In one or more embodiments, the method further comprises reflecting the first pressure pulse off an isolator disposed in the wellbore prior to colliding the first pressure pulse with the second pressure pulse. In one or more embodiments, the second time is based on a reflection time of the first pressure pulse to the first location. In one or more embodiments, the second time is based on a difference between the first time and a time for the second pressure pulse to reach the first location. In one or more embodiments, the method further comprises actuating a perforating tool to create one or more perforations in the wellbore, wherein at least one of the one or more perforations is at the first location. In one or more embodiments, the method further comprises retrieving the perforating tool from the wellbore prior to pumping the fluid into the wellbore. In one or more embodiments, the method further comprises extending the at least one of the one or more perforations by the first pressure spike to create the one or more fractures. In one or more embodiments, the method further comprises generating, at a third time, a third pressure pulse that propagates through the fluid pumped into the wellbore, generating, at a fourth time, a fourth pressure pulse that propagates through the fluid and colliding the third pressure pulse and the fourth pressure pulse to create a second pressure spike at a second location in the wellbore, wherein the second pressure spike is created independently of the first pressure spike.

In one or more embodiments, a method of creating a pressure spike in a wellbore of a formation comprises disposing, at a surface, a pump coupled to a conduit, wherein the conduit is fluidically coupled to the wellbore, coupling an injection pumping system to the conduit, pumping, by the pump, a fluid to the wellbore, generating, by the injection pumping system, a first pressure pulse at a first time that propagates through the fluid into the wellbore, generating, by the injection pumping system, a second pressure pulse at a second time that propagates through the fluid into the wellbore and colliding the first pressure pulse and the second pressure pulse to create a pressure pulse at a first location. In one or more embodiments, the method further comprises disposing a perforating tool in the wellbore prior to generating the first pressure pulse and the second pressure pulse and actuating the perforating tool to create one or more perforations in the formation at one or more locations in the wellbore. In one or more embodiments, the method further comprises disposing an isolator in the wellbore prior to generating the first pressure pulse and the second pressure pulse, wherein the first pressure pulse reflects off the isolator and wherein the second time is based on a reflection time of the first pressure pulse. In one or more embodiments, the method first comprises opening a first valve coupled to an accumulator of the injection pumping system to fill the accumulator with a pressurizing fluid and closing the first valve when a pressurizing limit of the accumulator is reached. In one or more embodiments, the generating the second pressure pulse comprises generating the second pressure pulse prior to completing generating of the first pressure pulse such that the second pressure pulse rides the first pressure pulse.

In one or more embodiments, a stimulation treatment system comprises a pump coupled to a conduit, wherein the conduit fluidically couples to a wellbore, an injection pumping system coupled to the conduit, wherein the pump pumps a fluid into the wellbore and wherein the injection pumping system generates at a first time an initial pressure pulse that propagates through the fluid and generates at a second time a subsequent pressure pulse such that the initial pressure pulse and the subsequent pressure pulse collide at a first location. In one or more embodiments, the injection pumping system comprises a piston assembly coupled to the conduit via a first valve. In one or more embodiments, the piston assembly comprises a first section and a second section, and wherein the piston reciprocates between the first section and the second section. In one or more embodiments, the fluid drawn into the second section is directed to the conduit when the first valve is opened. In one or more embodiments, the injection pumping system further comprises an accumulator coupled to a piston assembly via a first valve and a hydraulic pump coupled to the accumulator via a second valve and to the piston assembly via third valve. In one or more embodiments, the injection pumping system comprises a tank coupled to the piston assembly via a fourth valve. In one or more embodiments, the system further comprises an isolator disposed in the wellbore and wherein the initial pressure pulse reflects off the isolator.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A method for stimulation treatment of a wellbore m a formation, comprising:

generating, at a first time, a first pressure pulse that propagates through a fluid pumped into the wellbore;

generating, at a second time, a second pressure pulse that propagates through the fluid;

colliding the first pressure pulse and the second pressure pulse to create a first pressure spike at a first location in the wellbore; and creating one or more fractures in the formation by the first pressure spike, further comprising reflecting the first pressure pulse off an isolator disposed in the wellbore prior to colliding the first pressure pulse with the second pressure pulse.

2. The method of any of claim 1, wherein the second time is based on a reflection time of the first pressure pulse to the first location.

3. The method of any of claim 1, wherein the second time is based on a difference between the first time and a time for the second pressure pulse to reach the first location.

4. A method for stimulation treatment of a wellbore m a formation, comprising:

generating, at a first time, a first pressure pulse that propagates through a fluid pumped into the wellbore;

generating, at a second time, a second pressure pulse that propagates through the fluid;

colliding the first pressure pulse and the second pressure pulse to create a first pressure spike at a first location in the wellbore; and creating one or more fractures in the formation by the first pressure spike, further comprising actuating a perforating tool to create one or more perforations in the wellbore, wherein at least one of the one or more perforations is at the first location.

5. The method of claim 4, further comprising retrieving the perforating tool from the well bore prior to pumping the fluid into the well bore.

6. The method of claim 4, further comprising extending the at least one of the one or more perforations by the first pressure spike to create the one or more fractures.

7. A method for stimulation treatment of a wellbore m a formation, comprising:

generating, at a first time, a first pressure pulse that propagates through a fluid pumped into the wellbore;

generating, at a second time, a second pressure pulse that propagates through the fluid;

colliding the first pressure pulse and the second pressure pulse to create a first pressure spike at a first location in the wellbore; and creating one or more fractures in the formation by the first pressure spike, further comprising:

generating, at a third time, a third pressure pulse that propagates through the fluid pumped into the wellbore;

generating, at a fourth time, a fourth pressure pulse that propagates through the fluid; and colliding the third pressure pulse and the fourth pressure pulse to create a second pressure spike at a second location in the wellbore, wherein the second pressure spike is created independently of the first pressure spike.

8. A method of creating a pressure spike in a wellbore of a formation, comprising:

disposing, at a surface, a pump coupled to a conduit, wherein the conduit is fluidically coupled to the wellbore;

coupling an injection pumping system to the conduit;

pumping, by the pump, a fluid to the wellbore;

generating, by the injection pumping system, a first pressure pulse at a first time that propagates through the fluid into the wellbore;

generating, by the injection pumping system, a second pressure pulse at a second time that propagates through the fluid into the wellbore; and colliding the first pressure pulse and the second pressure pulse to create a pressure pulse at a first location, further comprising:

disposing a perforating tool in the wellbore prior to generating the first pressure pulse and the second pressure pulse; and actuating the perforating tool to create one or more perforations in the formation at one or more locations in the wellbore.

9. The method of creating the pressure spike in the wellbore of the formation of claim 8, further comprising:

disposing an isolator in the wellbore prior to generating the first pressure pulse and the second pressure pulse;

wherein the first pressure pulse reflects off the isolator; and wherein the second time is based on a reflection time of the first pressure pulse.

10. The method of creating the pressure spike in the wellbore of the formation of claim 8, further comprising:

opening a first valve coupled to an accumulator of the injection pumping system to fill the accumulator with a pressurizing fluid; and closing the first valve when a pressurizing limit of the accumulator is reached.

11. The method of creating the pressure spike in the wellbore of the formation of any of claim 8, wherein generating the second pressure pulse comprises generating the second pressure pulse prior to completing generating of the first pressure pulse such that the second pressure pulse rides the first pressure pulse.

12. A stimulation treatment system, comprising:

a pump coupled to a conduit, wherein the conduit fluidically couples to a wellbore;

an injection pumping system coupled to the conduit;

wherein the pump pumps a fluid into the wellbore; and wherein the injection pumping system generates at a first time an initial pressure pulse that propagates through the fluid and generates at a second time a subsequent pressure pulse such that the initial pressure pulse and the subsequent pressure pulse collide at a first location, wherein the injection pumping system comprises a piston assembly coupled to the conduit via a first valve.

13. The stimulation treatment system of claim 12, wherein the piston assembly comprises a first section and a second section, and wherein the piston reciprocates between the first section and the second section.

14. The stimulation treatment system of claim 13, wherein the fluid drawn into the second section is directed to the conduit when the first valve is opened.

15. The stimulation treatment system of any of claim 12, wherein the injection pumping system further comprises:

an accumulator coupled to the piston assembly via the first valve; and a hydraulic pump coupled to the accumulator via a second valve and to the piston assembly via a third valve.

16. The stimulation treatment system of any of claim 15, wherein the injection pumping system comprises a tank coupled to the piston assembly via a fourth valve.

17. A stimulation treatment system, comprising:

a pump coupled to a conduit, wherein the conduit fluidically couples to a wellbore;

an injection pumping system coupled to the conduit;

wherein the pump pumps a fluid into the wellbore; and wherein the injection pumping system generates at a first time an initial pressure pulse that propagates through the fluid and generates at a second time a subsequent pressure pulse such that the initial pressure pulse and the subsequent pressure pulse collide at a first location, further comprising:

an isolator disposed in the wellbore; and wherein the initial pressure pulse reflects off the isolator.

18. A method for stimulation treatment of a wellbore m a formation, comprising:

generating, at a first time, a first pressure pulse that propagates through a fluid pumped into the wellbore;

generating, at a second time, a second pressure pulse that propagates through the fluid;

colliding the first pressure pulse and the second pressure pulse to create a first pressure spike at a first location in the wellbore; and creating one or more fractures in the formation by the first pressure spike, wherein the second time is based on a reflection time of the first pressure pulse to the first location.

19. A method for stimulation treatment of a wellbore m a formation, comprising:

generating, at a first time, a first pressure pulse that propagates through a fluid pumped into the wellbore;

generating, at a second time, a second pressure pulse that propagates through the fluid;

colliding the first pressure pulse and the second pressure pulse to create a first pressure spike at a first location in the wellbore; and creating one or more fractures in the formation by the first pressure spike, wherein the second time is based on a difference between the first time and a time for the second pressure pulse to reach the first location.

20. A method of creating a pressure spike in a wellbore of a formation, comprising:

disposing, at a surface, a pump coupled to a conduit, wherein the conduit is fluidically coupled to the wellbore;

coupling an injection pumping system to the conduit;

pumping, by the pump, a fluid to the wellbore;

generating, by the injection pumping system, a first pressure pulse at a first time that propagates through the fluid into the wellbore;

generating, by the injection pumping system, a second pressure pulse at a second time that propagates through the fluid into the wellbore; and colliding the first pressure pulse and the second pressure pulse to create a pressure pulse at a first location, further comprising:

disposing an isolator in the wellbore prior to generating the first pressure pulse and the second pressure pulse;

wherein the first pressure pulse reflects off the isolator; and wherein the second time is based on a reflection time of the first pressure pulse.

21. A method of creating a pressure spike in a wellbore of a formation, comprising:

disposing, at a surface, a pump coupled to a conduit, wherein the conduit is fluidically coupled to the wellbore;

coupling an injection pumping system to the conduit;

pumping, by the pump, a fluid to the wellbore;

generating, by the injection pumping system, a first pressure pulse at a first time that propagates through the fluid into the wellbore;

generating, by the injection pumping system, a second pressure pulse at a second time that propagates through the fluid into the wellbore; and colliding the first pressure pulse and the second pressure pulse to create a pressure pulse at a first location, further comprising:

opening a first valve coupled to an accumulator of the injection pumping system to fill the accumulator with a pressurizing fluid; and closing the first valve when a pressurizing limit of the accumulator is reached.

* * * * *